US011638470B2

(12) United States Patent
Kani

(10) Patent No.: US 11,638,470 B2
(45) Date of Patent: May 2, 2023

(54) GALLIUM NITRIDE GEMSTONES

(71) Applicant: Arash Kani, Easton, CT (US)

(72) Inventor: Arash Kani, Easton, CT (US)

( * ) Notice: Subject to any disclaimer, the term of this patent is extended or adjusted under 35 U.S.C. 154(b) by 195 days.

(21) Appl. No.: 17/147,266

(22) Filed: Jan. 12, 2021

(65) Prior Publication Data

US 2022/0218078 A1 Jul. 14, 2022

(51) Int. Cl.
*A44C 17/00* (2006.01)

(52) U.S. Cl.
CPC ..... *A44C 17/007* (2013.01)

(58) Field of Classification Search
CPC ..... A44C 17/007
USPC ..... 63/32
See application file for complete search history.

(56) References Cited

U.S. PATENT DOCUMENTS

| | | | |
|---|---|---|---|
| 5,723,391 A | 3/1998 | Hunter et al. | |
| 6,656,615 B2 | 12/2003 | Dwilinski et al. | |
| 7,323,256 B2 | 1/2008 | Xu et al. | |
| 2016/0113363 A1* | 4/2016 | Dymshits | C03C 10/0054 501/86 |

OTHER PUBLICATIONS https://www.gan.msm.cam.ac.uk/resources/crystalmodels.
https://ece.illinois.edu/newsroom/news/3591.
https://phys.org/news/2019-12-low-cost-gallium-nitride-gan-crystal.html.
https://en.wikipedia.org/wiki/Diamond_cut.
https://link.springer.com/referenceworkentry/10.1007%2F978-3-319-00176-0_11; See Abstract of "LED Materials: GaN on Si".
https://www.laserfocusworld.com/lasers-sources/article/16556887/lightemitting-diodes-ganongan-platform-removes-costperformance-tradeoffs-in-led-lighting.

* cited by examiner

*Primary Examiner* — Jack W Lavinder
(74) *Attorney, Agent, or Firm* — Edlavitch Law PLLC

(57) ABSTRACT

Different types of gallium nitride (GaN) gemstones can be produced synthetically for crafting jewelry. With some examples, a GaN gemstone can include a crystal (such as a single crystal that is typically used in semiconductor devices or other types of electronic components, e.g., electronic components with optical properties). The crystal of the gemstone can be grown to be relatively pure and translucent GaN as well as cut and polished to have facets of a gemstone. Also, the crystal can include doped GaN—such as GaN doped with indium or aluminum. The doping of the GaN can be to an extent to produce a visibly discernable color (such a tint of blue).

20 Claims, 12 Drawing Sheets

100

200

300

400

Oval

Princes

Radiant

Baguette

Emerald

Asscher

Cushion

Pear

Marquise

TOP VIEW
OF
ROSE CUT

SIDE VIEW
OF
ROSE CUT

BOTTOM VIEW
OF
ROSE CUT

GALLIUM NITRIDE GEMSTONES

TECHNICAL FIELD

The present disclosure relates to synthetic gemstones.

BACKGROUND

Synthetic diamonds for use as gemstones can be grown by high pressure and high temperature (HPHT) methods or chemical vapor deposition (CVD) methods. The demand for synthetic gemstones is growing over time as well as the costs associated with the production of such gemstones has decreased. Advances in technology allow for larger higher-quality synthetic production at lower costs. Synthetic diamonds can be generated in several tints, such as yellow, green, and blue, or for the most part colorless. The yellow color can be derived from nitrogen impurities in the manufacturing process, while the blue color can come from boron. Other colors can be produced after synthesis using irradiation. Diamonds grown in a lab can be chemically, physically and optically similar to naturally occurring diamonds. Synthetic diamonds can be distinguished by spectroscopy in the infrared, ultraviolet, or X-ray wavelengths.

U.S. Pat. No. 5,723,391A discloses silicon carbide gemstones. Such gemstones have been shown to have extraordinary brilliance and hardness and can be formed from large single crystals of relatively low impurity, translucent silicon carbide of a single polytype that are grown in a furnace sublimation system. The silicon carbide crystals can be cut into rough gemstones that are thereafter fashioned into finished gemstones that are somewhat similar to diamonds. A wide range of colors and shades is available by selective doping of the silicon carbide crystal during growth. A colorless silicon carbide gemstone is produced by growing the crystal undoped in a system substantially free of unwanted impurity atoms.

SUMMARY

Described herein are gallium nitride (GaN) gemstones and some applications of such gemstones in jewelry. For example, a piece of jewelry having a GaN gemstone can include a light-emitting diode (LED) that can illuminate the gemstone. Also, a piece of jewelry can have a GaN gemstone that has been fabricated to function as an LED.

In some embodiments, a GaN gemstone can include a crystal (such as a single crystal that is typically used in semiconductor devices or other types of electronic components, e.g., electronic components with optical properties). The crystal of the gemstone can be grown to be relatively pure and translucent GaN as well as cut and polished to have facets of a gemstone. Also, the crystal can include doped GaN—such as GaN doped with indium or aluminum. The doping of the GaN can be to an extent to produce a visibly discernable color (such a tint of blue).

In some embodiments, the GaN gemstones can exhibit a brilliance and a hardness similar to naturally occurring diamonds. And, the GaN gemstones can be formed from large single crystals of relatively low impurity, translucent gallium nitride of a single polytype that can be grown in a furnace sublimation system. The gallium nitride crystals can be cut into rough gemstones that are thereafter fashioned into finished gemstones. A wide range of colors and shades is available by selective doping of the gallium nitride crystal during growth.

A colorless gallium nitride gemstone can be produced by growing the crystal undoped in a system substantially free of impurity atoms. The GaN gemstones can include a crystal that has synthetic gallium nitride and polished faces. The polished faces can be polished to an extent to let visible light pass through the faces, and the visible light that passes through the faces can include electromagnetic radiation with wavelengths ranging from 380 to 750 nanometers.

These and other important aspects of the invention are described more fully in the detailed description below. The invention is not limited to the particular methods and systems described herein. Other embodiments can be used and changes to the described embodiments can be made without departing from the scope of the claims that follow the detailed description.

BRIEF DESCRIPTION OF THE DRAWINGS

The present disclosure will be understood more fully from the detailed description given below and from the accompanying drawings of various embodiments of the disclosure.

DETAILED DESCRIPTION OF EXAMPLE EMBODIMENTS

Details of example embodiments of the invention are described in the following detailed description with reference to the drawings. Although the detailed description provides reference to example embodiments, it is to be understood that the invention disclosed herein is not limited to such example embodiments. But to the contrary, the invention disclosed herein includes numerous alternatives, modifications and equivalents as will become apparent from consideration of the following detailed description and other parts of this disclosure.

Figure 30:
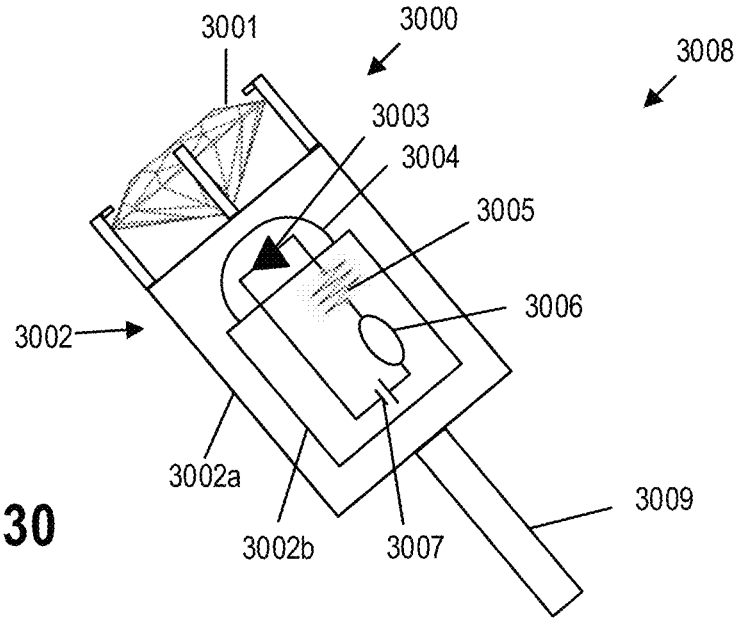
FIGS. 30 and 31 illustrate schematic views of jewelry including a synthetic gemstone combined with an LED system for illuminating the gemstone, with some portions of a housing of the jewelry being broken away to reveal internal details of construction, in accordance with some embodiments of the present disclosure.
Figure 31:
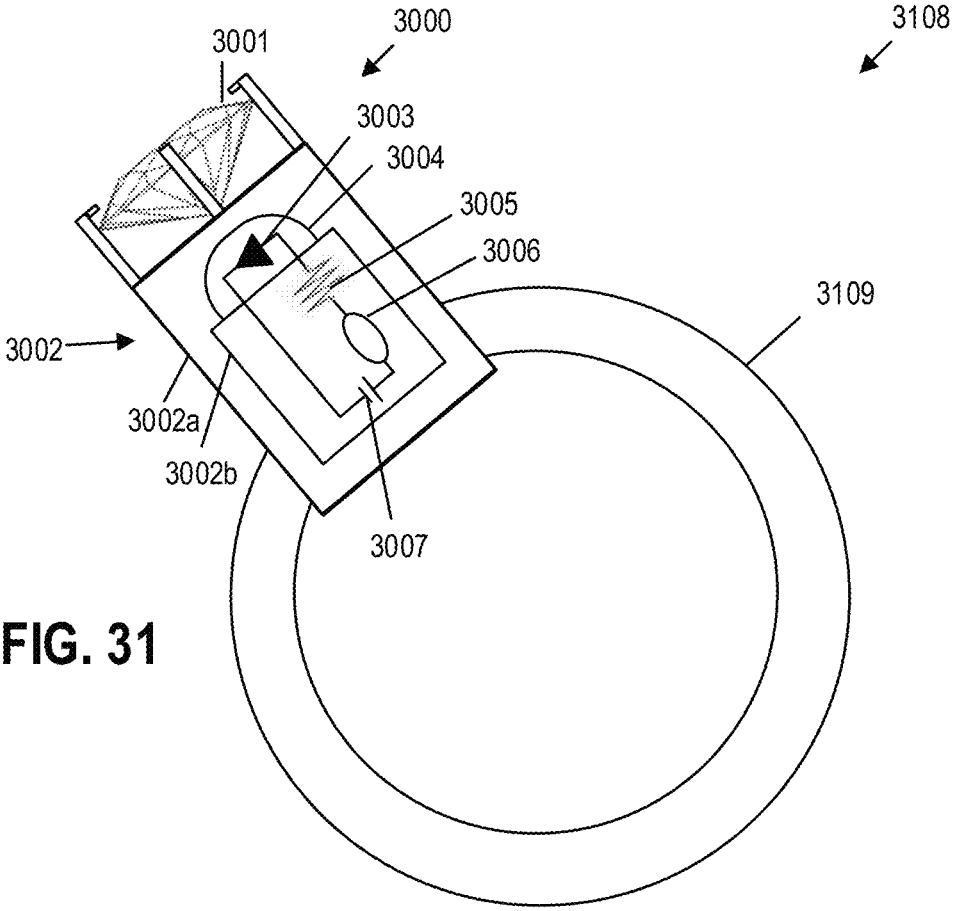
Figure 34:
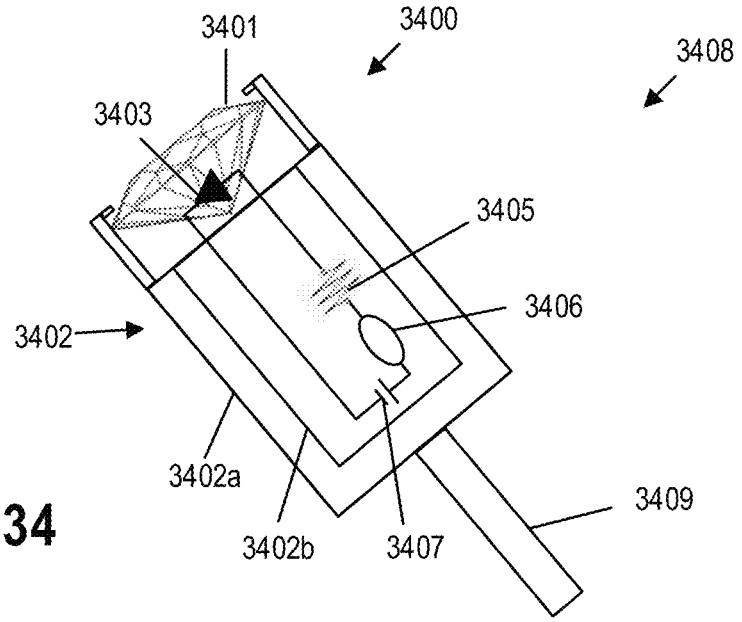
FIGS. 34 and 35 illustrate schematic views of jewelry including a synthetic gemstone that functions as an LED, with some portions of a housing of the jewelry being broken away to reveal internal details of construction, in accordance with some embodiments of the present disclosure.
Figure 35:
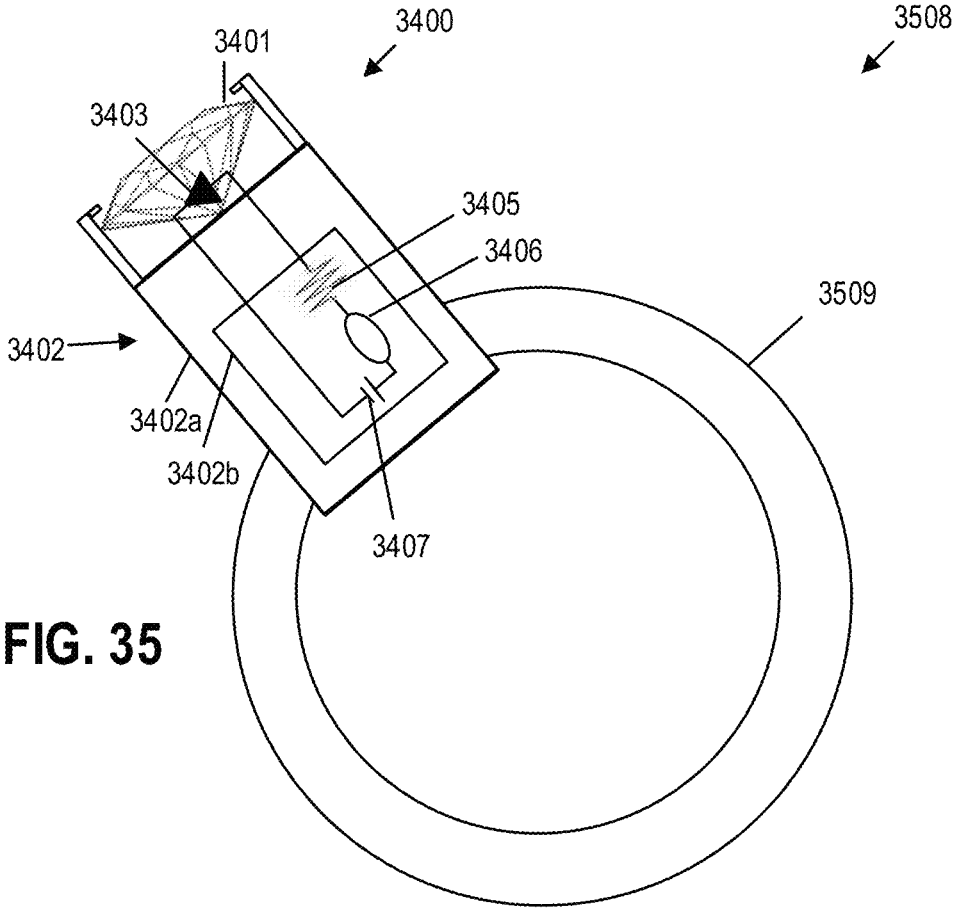

Described herein are gallium nitride (GaN) gemstones and some applications of such gemstones in jewelry (e.g., see the jewelry depicted in FIGS. 30 and 31 as well as FIGS. 34 and 35). In some embodiments, a piece of jewelry can have a GaN gemstone and also include a light-emitting diode (LED) that can illuminate the gemstone from a side of the stone, over a top of the stone, and/or through the bottom of the stone (e.g., see the LED depicted in FIGS. 30 and 31 which resides beneath the gemstone so that it can illuminate light through the stone from the bottom of the stone to the top of the stone). In some embodiments, a piece of jewelry can have a GaN gemstone that functions as an LED (e.g., see the LED depicted in FIGS. 34 and 35).

Figure 1:
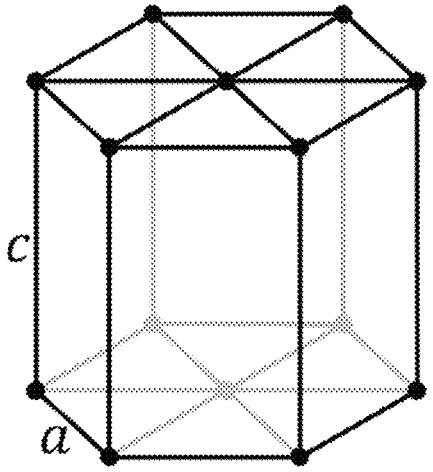
FIG. 1 illustrates a schematic view of a hexagonal crystal structure, in accordance with some embodiments of the present disclosure.

In some embodiments, a gemstone can include a crystal (such as a single crystal that is typically used in semiconductor devices or other types of electronic components, e.g., electronic components with optical properties). The crystal can have a hexagonal structure as shown in FIG. 1 or a cubic structure (e.g., see example cubic structures depicted in FIGS. 2 to 4). The crystal of the gemstone can be grown to be relatively pure and translucent GaN as well as cut and polished to have facets of a gemstone (e.g., see the method illustrated in FIG. 29). Also, the crystal can include doped GaN—such as GaN doped with indium or aluminum (e.g., see optional step 2908 shown in FIG. 29). The doping of the GaN can be to an extent to produce a visibly discernable color (such a tint of blue, green, or orange).

In some embodiments, a gemstone includes a crystal that includes synthetic gallium nitride having a cubic or hexagonal crystal structure (e.g., see the crystal structures in FIGS. 1 to 4). The gemstone also includes a plurality of polished faces (or facets), e.g., see the polished facets of the gemstones shown in FIGS. 5 to 28. The plurality of polished faces is polished to an extent to let visible light pass through the plurality of faces. The visible light includes electromagnetic radiation with wavelengths ranging from 380 to 750 nanometers. In some embodiments, the gemstone is a synthetic gemstone, having a crystal that includes GaN and the plurality of polished faces. In such embodiments and others, the gallium nitride can be extrinsic gallium nitride. And, the crystal can include either indium or aluminum added to the crystal intentionally. On the other hand, the gallium nitride can be intrinsic gallium nitride. In such embodiments and others, the plurality of faces is configured according to a gem cut (e.g., see the gem cuts shown in FIGS. 5 to 28).

In the aforesaid embodiments and others, the crystal is monocrystalline. Also, the plurality of polished faces can be polished to an extent to let the visible light enter into the gemstone, reflect from inside the gemstone, and exit the gemstone. The crystal can include indium or aluminum, or a combination thereof. Or, the gallium nitride can be intrinsic gallium nitride. Either way, the crystal structure of the gemstone includes a hexagonal crystal structure or a cubic crystal structure. Also, the crystal of the gemstone can be colorless or include a tint of color (such as blue, green, or orange). To have color, the crystal can include a dopant of atoms at a concentration sufficient to produce a visibly discernable color. The dopant can include aluminum atoms or indium atoms.

In the aforesaid embodiments and others, the plurality of faces is configured according to a diamond cut. For example, the diamond cut can be a brilliant cut (e.g., see the brilliant round cut shown in FIGS. 5 to 7 as well as the brilliant cushion cut shown in FIGS. 20 and 21). Also, for example, the diamond cut can be a modified brilliant cut (e.g., see the modified brilliant cuts shown in FIGS. 8 and 9 and FIGS. 22 to 25), a step cut (e.g., see the step cuts shown in FIGS. 14 to 19), a mixed cut (e.g., see the mixed cuts shown in FIGS. 10 to 13), a rose cut (e.g., see the rose cut shown in FIGS. 26 to 28), a mogul cut (not depicted), or any other known gemstone cut.

FIG. 1 illustrates a schematic view of a hexagonal crystal structure 100, in accordance with some embodiments of the present disclosure. It is to be understood that some embodiments of the GaN crystal that forms the synthetic gemstone has a hexagonal crystal structure such as the hexagonal crystal structure 100. In other words, the crystal that forms the synthetic gemstone can have a Wurtzite crystal structure.

Figure 2:
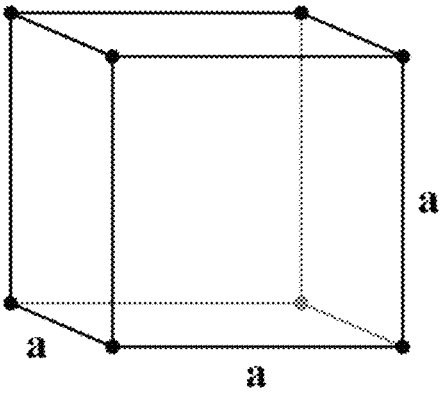
FIGS. 2, 3, and 4 illustrate respective schematic views of different types of cubic crystal structures, in accordance with some embodiments of the present disclosure.

FIG. 2 illustrates a schematic view of a primitive cubic structure 200, in accordance with some embodiments of the present disclosure. It is to be understood that some embodiments of the GaN crystal that forms the synthetic gemstone has a primitive cubic crystal structure such as the primitive cubic structure 200. Such embodiments are experimental and may require other types of atoms beyond gallium and nitrogen atoms to produce the primitive cubic structure. Also, such embodiments may include a crystal that is not as translucent or resilient as embodiments where the crystal has a hexagonal crystal structure.

Figure 3:
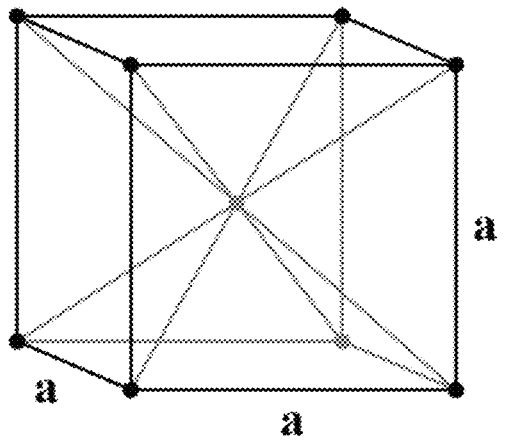

FIG. 3 illustrates a schematic view of a body-centered cubic structure 300, in accordance with some embodiments of the present disclosure. It is to be understood that some embodiments of the GaN crystal that forms the synthetic gemstone has a body-centered cubic structure such as the body-centered cubic structure 300. Such embodiments are experimental and may require other types of atoms beyond gallium and nitrogen atoms to produce the body-centered cubic structure. Also, such embodiments may include a crystal that is not as translucent or resilient as embodiments where the crystal has a hexagonal crystal structure.

Figure 4:
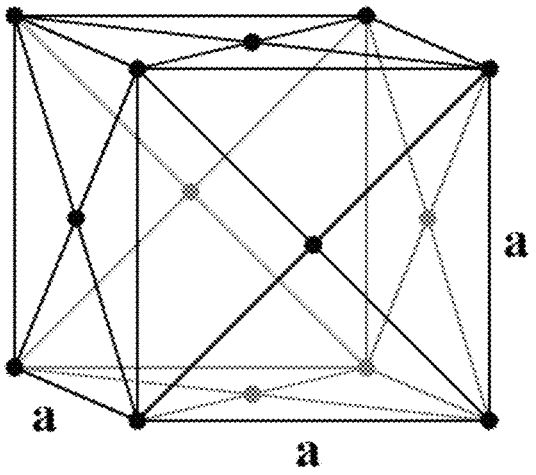

FIG. 4 illustrates a schematic view of a face-centered cubic structure 400, in accordance with some embodiments of the present disclosure. It is to be understood that some embodiments of the GaN crystal that forms the synthetic gemstone has a face-centered cubic structure such as the face-centered cubic structure 400. Such embodiments are experimental and may require other types of atoms beyond gallium and nitrogen atoms to produce the face-centered cubic structure. Also, such embodiments may include a crystal that is not as translucent or resilient as embodiments where the crystal has a hexagonal crystal structure.

Figure 5:
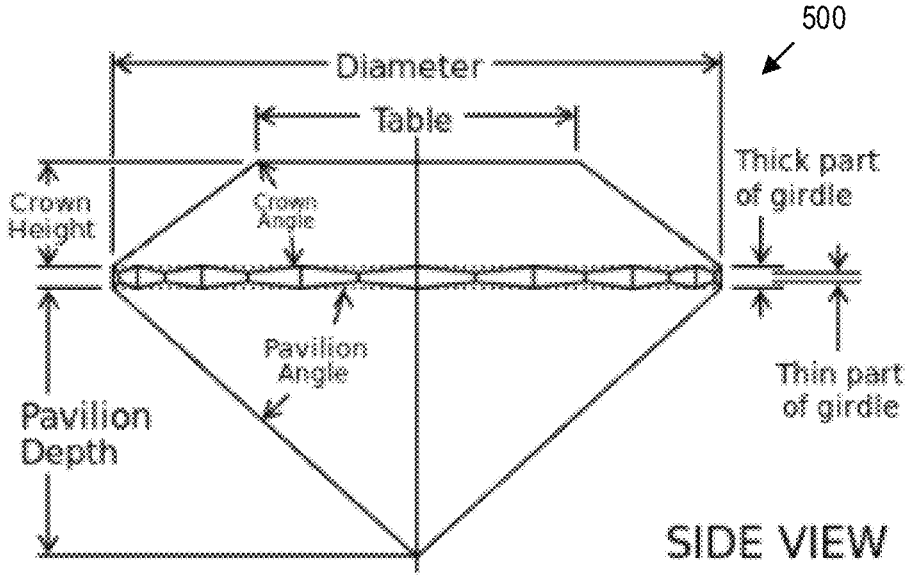
FIGS. 5 to 28 illustrate schematic views of finished synthetic gemstones, in accordance with some embodiments of the present disclosure.
Figure 6:
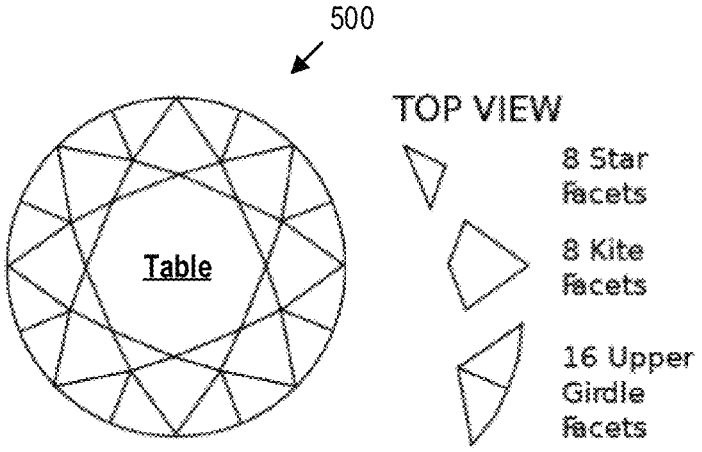
Figure 7:
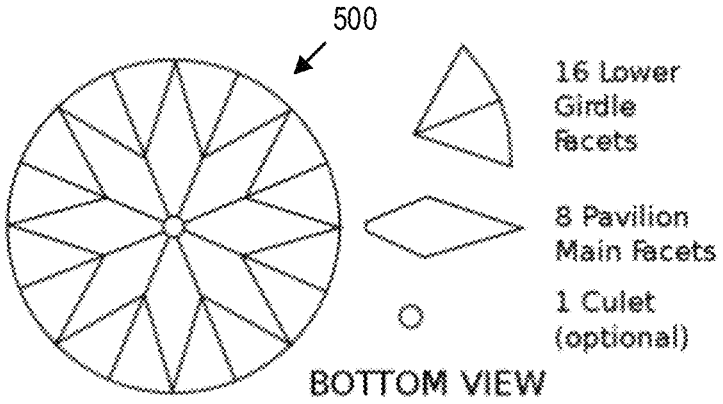

FIG. 5 illustrates a schematic side view of a finished synthetic gemstone having a round brilliant diamond cut 500, in accordance with some embodiments of the present disclosure. FIG. 6 illustrates a schematic top view of the finished synthetic gemstone having the round brilliant diamond cut 500. FIG. 7 illustrates a schematic bottom view of the finished synthetic gemstone having the round brilliant diamond cut 500. FIGS. 6 and 7 also show a legend of facet types. As shown in FIGS. 5 to 7, the round brilliant diamond cut 500 includes fifty-eight facets (or fifty-seven facets if the culet is excluded); thirty-three on the crown (the top half above the middle or girdle of the stone) and twenty-five on the pavilion (the lower half below the girdle). The girdle of the round brilliant diamond cut 500 can be frosted, polished smooth, or faceted. In some embodiments, the girdles are faceted. The girdles can have thirty-two, sixty-four, eighty, or ninety-six facets (depending on the embodiment). Such facets are excluded from the total facet count. Likewise, some embodiments of the gemstone can have small extra facets on the crown or pavilion that were created to remove surface imperfections during the cutting process. FIG. 5 assumes that the thick part of the girdle of the round brilliant diamond cut 500 is the same thickness at all sixteen thick parts. It does not consider the effects of indexed upper girdle facets.

Figure 8:
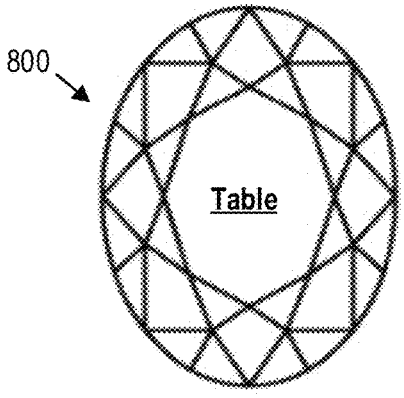
Figure 9:
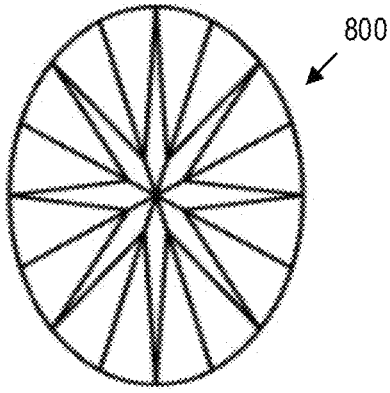

FIG. 8 illustrates a schematic top view of the finished synthetic gemstone having an oval diamond cut 800, in accordance with some embodiments of the present disclosure. FIG. 9 illustrates a schematic bottom view of the finished synthetic gemstone having the oval diamond cut 800. The oval diamond cut 800 is a modified brilliant cut. In some embodiments, the oval diamond cut 800 has fifty-six facets, and the weight of such a cut gemstone is estimated by measuring the length and width of the stone. In some embodiments, a ratio of 1.33 to 1.66 provides a traditional range of the oval diamond cut 800. As shown in FIGS. 8 and 9, the oval diamond cut 800, somewhat similar to the round brilliant diamond cut 500, at least includes thirty-three facets on its crown (which includes the table facet) and thirty-three facets on its pavilion.

Figure 10:
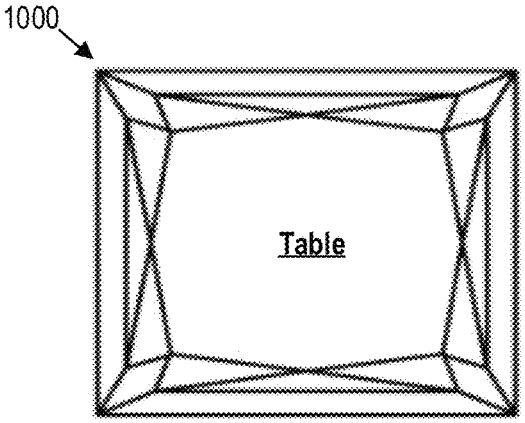
Figure 11:
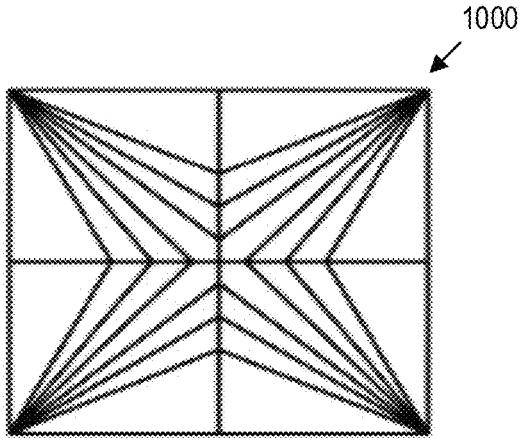

FIG. 10 illustrates a schematic top view of the finished synthetic gemstone having a princess diamond cut 1000, in accordance with some embodiments of the present disclosure. FIG. 11 illustrates a schematic bottom view of the finished synthetic gemstone having the princess diamond cut 1000. The princess diamond cut 1000 is a mixed cut—which accentuates a gemstone's brilliance rather than its luster. The princess diamond cut 1000 can be beneficial over other cuts because typically it wastes the least of the original crystal. Some embodiments of the gemstone can be the Princess 144, with 144 facets and 8-fold symmetry. However, this should not be confused with the princess diamond cut 1000, which is a mixed princess cut. The Princess 144 cut has better scintillation than the princess diamond cut 1000; and its extra facets are cut under the girdle rather than subdivided. The extra care required for these sub-girdle facets benefits the finished stone by mitigating girdle irregularity and bearding (hairline fracturing). As shown in FIGS. 10 and 11, the princess diamond cut 1000 at least includes twenty-one facets on its crown (which includes the table facet) and twenty-eight facets on its pavilion.

Figure 12:
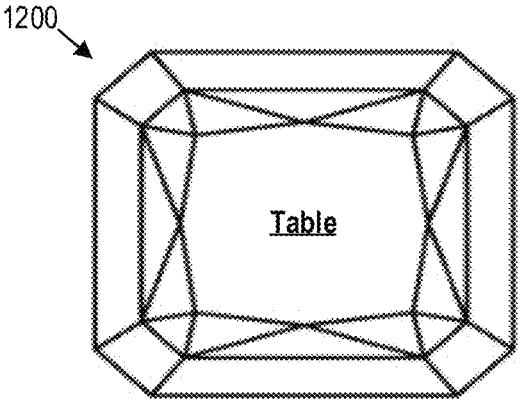
Figure 13:
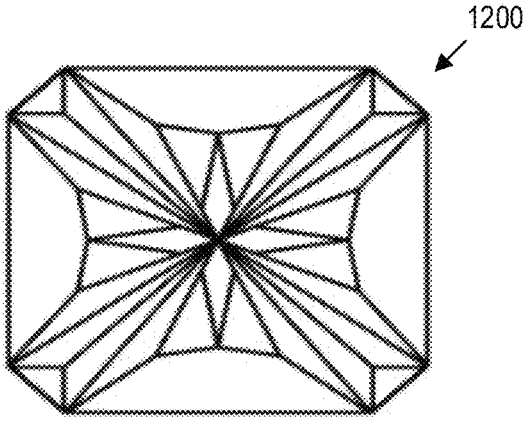

FIG. 12 illustrates a schematic top view of the finished synthetic gemstone having a radiant diamond cut 1200, in accordance with some embodiments of the present disclosure. FIG. 13 illustrates a schematic bottom view of the finished synthetic gemstone having the radiant diamond cut 1200. The radiant diamond cut 1200 is a mixed cut and has a total of seventy facets. In some embodiments, the cut can be a modified radiant cut or a Barion cut (not depicted) or a modified Barion cut. Such modifications have slightly different facet arrangements and combinations. As shown in FIGS. 12 and 13, the radiant diamond cut 1200 at least includes twenty-five facets on its crown (which includes the table facet) and thirty-six facets on its pavilion.

Figure 14:
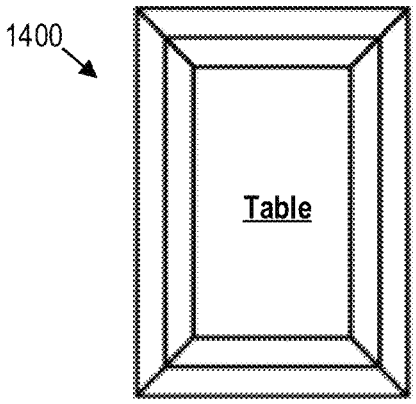
Figure 15:
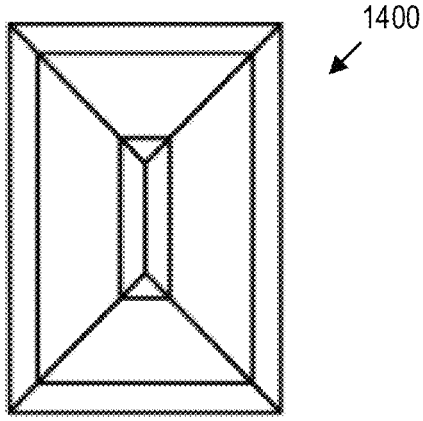

FIG. 14 illustrates a schematic top view of the finished synthetic gemstone having a baguette diamond cut 1400, in accordance with some embodiments of the present disclosure. FIG. 15 illustrates a schematic bottom view of the finished synthetic gemstone having the baguette diamond cut 1400. The baguette diamond cut 1400 is a step cut—which accentuates a gemstone's luster, whiteness, and clarity but downplays its brilliance. A slender, rectangular version of the baguette diamond cut 1400 can be used as an accent stone to flank a ring's larger central (and usually brilliant cut) stone. As shown in FIGS. 14 and 15, the baguette diamond cut 1400 at least includes nine facets on its crown (which includes the table facet) and twelve facets on its pavilion.

Figure 16:
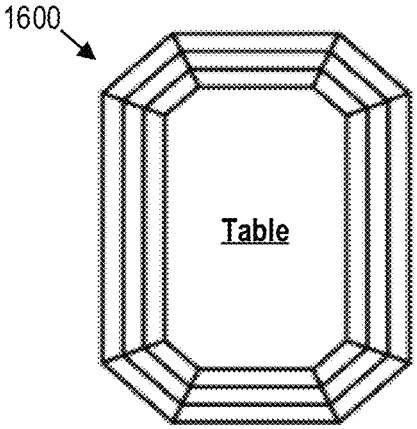
Figure 17:
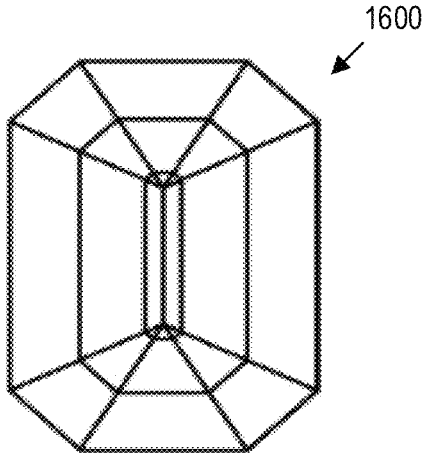

FIG. 16 illustrates a schematic top view of the finished synthetic gemstone having an emerald diamond cut 1600, in accordance with some embodiments of the present disclosure. FIG. 17 illustrates a schematic bottom view of the finished synthetic gemstone having the emerald diamond cut 1600. The emerald diamond cut 1600 is a step cut. Emerald cut stones, such as in the emerald diamond cut 1600, have their corners truncated with an octagonal outline. This is done because sharp corners are points of weakness where a gemstone may cleave or fracture. Instead of a culet, step-cut stones have a keel running the length of the pavilion terminus. Like other fancy shaped gemstones, emerald cut gemstones can come in a variety of length to width ratios. Some embodiments of the gemstone can have a classic outline of emerald cut diamonds which have a length-to-width ratio of 1.5. As shown in FIGS. 16 and 17, the emerald diamond cut 1600 at least includes twenty-five facets on its crown (which includes the table facet) and twenty-four facets on its pavilion.

Figure 18:
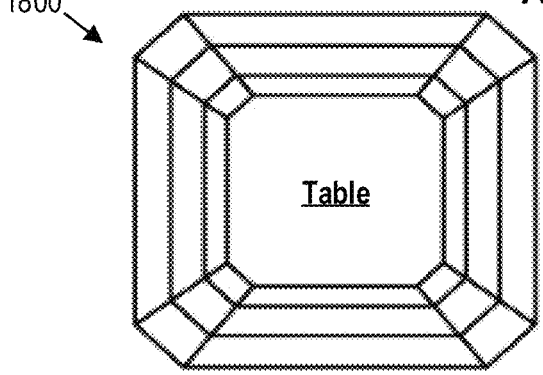
Figure 19:
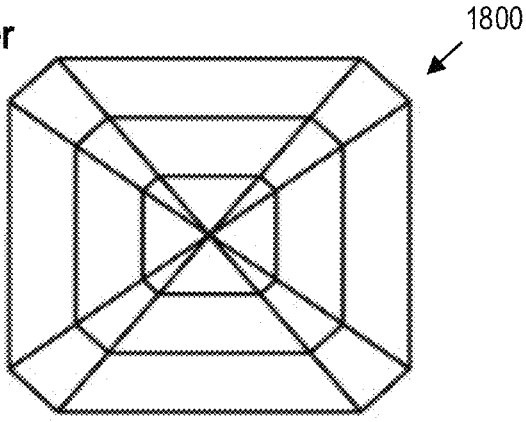

A square modified emerald cut is considered an Asscher cut. FIG. 18 illustrates a schematic top view of the finished synthetic gemstone having an Asscher diamond cut 1800, in accordance with some embodiments of the present disclosure. FIG. 19 illustrates a schematic bottom view of the finished synthetic gemstone having the Asscher diamond cut 1800. As shown in FIGS. 18 and 19, the Asscher diamond cut 1800 at least includes twenty-five facets on its crown (which includes the table facet) and twenty-four facets on its pavilion.

Figure 20:
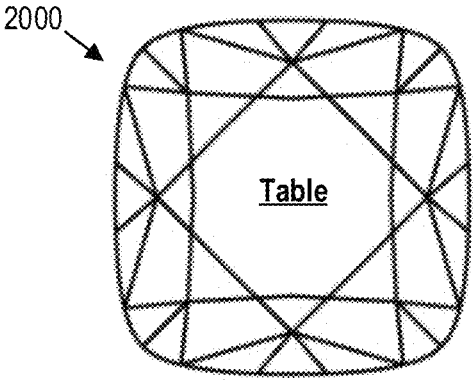
Figure 21:
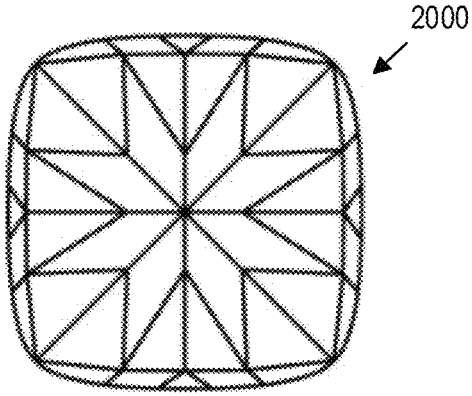

FIG. 20 illustrates a schematic top view of the finished synthetic gemstone having cushion diamond cut 2000, in accordance with some embodiments of the present disclosure. FIG. 21 illustrates a schematic bottom view of the finished synthetic gemstone having the cushion diamond cut 2000. The cushion diamond cut 2000 is a brilliant cut and can have a rounded square or rectangle in its cross-section rather than a circle or oval as found in the round brilliant diamond cut 500 or the oval diamond cut 800, respectively. As shown in FIGS. 20 and 21, the cushion diamond cut 2000 at least includes thirty-seven facets on its crown (which includes the table facet) and forty-four facets on its pavilion.

Figure 22:
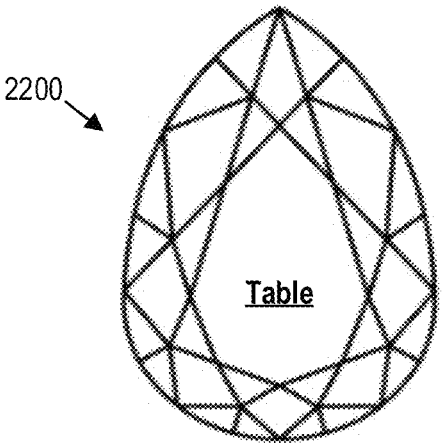
Figure 23:
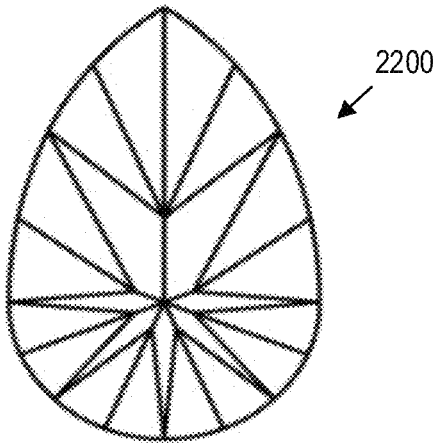

FIG. 22 illustrates a schematic top view of the finished synthetic gemstone having pear diamond cut 2200, in accordance with some embodiments of the present disclosure. FIG. 23 illustrates a schematic bottom view of the finished synthetic gemstone having the pear diamond cut 2200. The pear diamond cut 2200 is a modified brilliant cut—which includes a teardrop shape and can be a hybrid between a marquise cut and a round brilliant cut. An embodiment with the pear diamond cut 2200 has one end rounded while the other end is pointed. Such an embodiment can opt between varying length and width ratios (e.g., length to width ratios between 1.45 and 1.75). As shown in FIGS. 22 and 23, the pear diamond cut 2200 at least includes thirty-three facets on its crown (which includes the table facet) and twenty-three facets on its pavilion.

Figure 24:
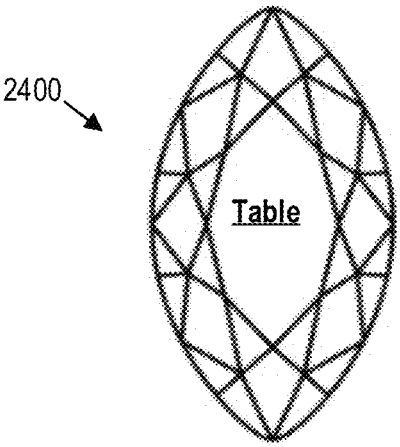
Figure 25:
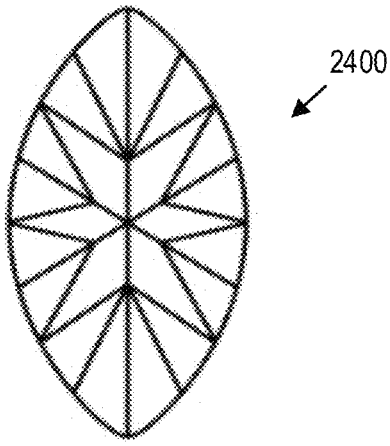

FIG. 24 illustrates a schematic top view of the finished synthetic gemstone having marquise diamond cut 2400, in accordance with some embodiments of the present disclosure. FIG. 25 illustrates a schematic bottom view of the finished synthetic gemstone having the marquise diamond cut 2400. The marquise diamond cut 2400 is a modified brilliant cut—which includes a lemon-shape. Another embodiment can include a hear diamond cut (not depicted), which is another type of modified brilliant cut. As shown in FIGS. 24 and 25, the marquise diamond cut 2400 at least includes thirty-three facets on its crown (which includes the table facet) and twenty-two facets on its pavilion.

Figure 26:
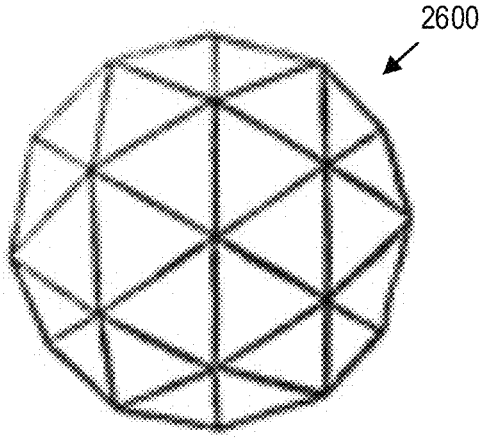
Figure 27:
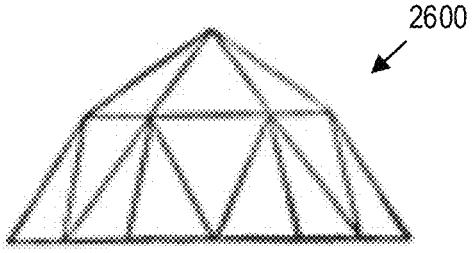

FIG. 26 illustrates a schematic top view of the finished synthetic gemstone having rose diamond cut 2600, in accordance with some embodiments of the present disclosure. FIG. 27 illustrates a schematic side view of the finished synthetic gemstone having the rose diamond cut 2600. FIG.

Figure 28:
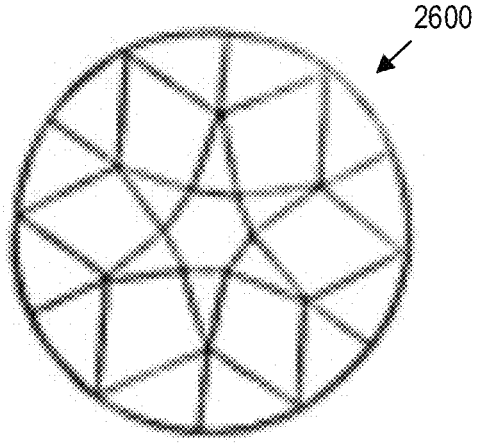

28 illustrates a schematic bottom view of the finished synthetic gemstone having the rose diamond cut 2600. The rose diamond cut 2600 is similar to a step cut but not a step cut nor a brilliant cut. The rose diamond cut 2600 has a flat base—that is, it lacks a pavilion—and has a crown composed of triangular facets (usually twelve or twenty-four) rising to form a point (there is no table facet) in an arrangement with sixfold rotational symmetry. Related to the rose cut is a mogul cut (not depicted)—which lacks a pavilion and a table facet, and its crown is also composed of triangular facets rising to form a point. But in mogul-cut diamonds the rotational symmetry is normally fourfold or eightfold, and the eight apical facets are girded by two or more additional rings of facets. As shown in FIGS. 26 to 28, the rose diamond cut 2600 at least includes twenty-four facets on its crown and twenty-five facets on its pavilion.

Figure 29:
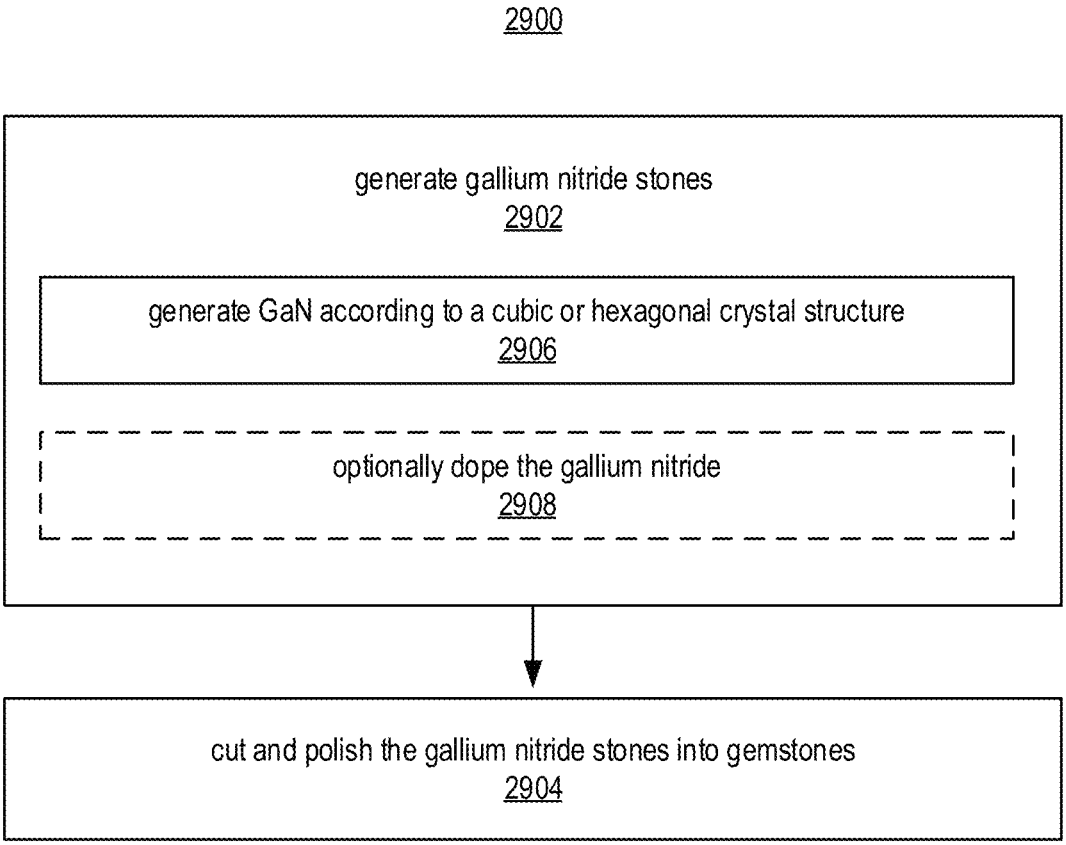
FIG. 29 illustrates a method for fabricating synthetic gemstones, in accordance with some embodiments of the present disclosure.

FIG. 29 illustrates a method 2900 for producing synthetic gemstones, in accordance with some embodiments of the present disclosure. As shown, the method 2900 begins, at step 2902, with generating gallium nitride stones, such as rough GaN stones. Subsequent to generating the GaN stones, the method 2900 continues, at step 2904, with cutting and polishing the GaN stones into gemstones. At step 2906, during step 2902, the generation of the GaN stones begins with either generating a GaN cubic crystal structure or a GaN hexagonal crystal structure. At step 2908, during step 2902, the generation of the GaN stones can optionally include doping the GaN of the stones. With respect to the method 2900, some embodiments of the stones include a low impurity, translucent, single crystal gallium nitride, which can be grown with desired color (at steps 2902 and 2908) and thereafter cut, faceted and polished into synthetic finished gemstones (at step 2904).

The finished gemstones produced at step 2904 can have a hardness approaching or exceeding that of diamond, acceptable toughness for fabricating gemstones further, acceptable thermal and chemical stability, and a high refractive index that renders the gallium nitride gemstone as brilliant, if not more brilliant, than diamond. In such examples, a single crystal of GaN, which can be consistent color, is grown by a technique such as the sublimation technique disclosed in U.S. Pat. No. Re. 34,861, at step 2902. Instead of slicing the large crystal into many thin slices, the crystals serve as boules that are cut into rough synthetic gemstones having a weight on the order of, for example, 1/16 to 10 carats. This last-mentioned step can be a part of step 2904. The rough gemstones can then be fashioned into finished synthetic GaN gemstones at step 2904. The faceting and polishing techniques can be derived from those techniques used in connection with the faceting and polishing of colored gemstones such as rubies and sapphire, incorporating certain procedures utilized in connection with diamonds.

In some embodiments of the method 2900, at step 2902, single crystals of gallium nitride are grown under the same or similar conditions that are used to produce crystals having the low impurity levels necessary for semiconductor applications. In some other examples, higher impurity levels are used within accepted ranges consistent with the need for materials having suitable translucence and other optical properties for gemstone use. Also, at step 2902, gallium nitride crystals can be grown in a wide range of colors (including green, blue, red, violet, yellow, and orange) and shades within each color by selection of certain amounts of dopants (e.g., p-type dopants, n-type dopants, silicon, oxygen, boron, aluminum, indium, thallium, tin, lead, bismuth, and transition metals, such as magnesium) and by varying the net doping densities (concentrations)—at step 2908. In some embodiments, undoped gallium nitride crystals in the hexagonal or rhombohedral forms are colorless and meet, or exceed, the brilliance of diamond.

After generation of rough gemstones, at step 2902, the GaN gemstones are cut from large single crystals and then fashioned into finished gemstones by a combination of techniques currently employed in connection with conventional colored gemstones and diamonds—at step 2904. The hardness and toughness of gallium nitride permits the stones to be faceted with very sharp edges, thus enhancing the overall appearance and brilliance of the stones.

In some embodiments of the method 2900, the step 2902 can output a boule, or a single-crystal ingot produced by synthetic means. The boule can include a large single crystal of gallium nitride that can weigh approximately 100 to 1000 carats. In some examples, at step 2904, approximately 20 to 200 5-carat rough synthetic gemstones can be cut from the large single crystal. Each of the 5-carat rough gemstone, when fashioned into a finished gemstone, will yield an approximate sized gemstone on the order of one to three carats. In such embodiments, the single crystal can be made of atoms having the crystal structure shown in FIG. 1. In other words, the crystal structure is hexagonal. It is also possible to grow variations of GaN in a cubic structure; however, such growth is known to lead to crystal structure that is less translucent and stable. In exemplary embodiments, the crystal is formed of a single polytype, for example, a hexagonal form such as GaN, 2H—GaN, or 4H—GaN, and has a low enough impurity level to render the crystal sufficiently translucent for use as a gemstone.

In some embodiments of the method 2900, at the step 2902, the crystal is grown by a sublimation or deposition or other growth technique used to grow large (bulk) gallium nitride single crystals, with an exemplary method including sublimation growth on a seed crystal. According to such an exemplary technique, the crystal is grown by introducing a polished monocrystalline seed crystal of gallium nitride of a desired polytype into the furnace of a sublimation system along with gallium and nitrogen containing source gas or powder (source material). The source material can be heated to a temperature that causes the source material to create a vapor flux that deposits vaporized variants of gallium, nitrogen, and gallium nitride to the growth surface of the seed crystal. The reproducible growth of a single selected polytype on the seed crystal can be achieved by maintaining a flux of gallium, nitrogen, and gallium nitride, and by controlling the thermal gradient between the source material and the seed crystal. Crystals grown by sublimation techniques have been used as a material from which very thin slices are taken for use in the production of semiconductor devices. These slices can vary in color, such as be tinted green or blue, with the color (and desired electrical properties) achieved by intentionally doping with selected dopants at selected concentrations during the growth process. Such doping can occur at step 2908.

Also, in some embodiments, undoped (intrinsic) gallium nitride can be grown to be colorless gallium nitride single crystals. At step 2902, the crystal growth system can be maintained substantially free of unwanted gaseous or vaporized impurity atoms that would result in unintentional doping of the crystal as it grows utilizing low pressure bake-out techniques as are well known in the art. Colorless gallium nitride can include GaN, 2H—GaN, and 4H—GaN. The seed for initiating growth of the single crystal for such gemstones is the seed having the same molecular type, GaN, 2H—GaN, and 4H—GaN respectively.

Also, step 2902 can include the use of a hydride vapor phase epitaxy (HVPE) method. However, it can be difficult to produce thick GaN crystals using the HVPE method due to distortions in the crystal, and GaN crystals are grown on a seed crystal heterogeneous substrate. Although, improvements beyond the scope of this application are being made.

In some embodiments, at step 2902, GaN with a high crystalline quality can be obtained by depositing a buffer layer at low temperatures. Such high-quality GaN can include p-type GaN, which can include a blue or a variation on blue tint. The GaN stone grown can include the range of primary color tints. To produce such GaN, a thin film of GaN can be deposited via Metal-Organic Vapor Phase Epitaxy (MOVPE) on sapphire. Other substrates that can be used are zinc oxide, with lattice constant mismatch of only 2% and silicon carbide (SiC).

In some embodiments, at step 2902, GaN crystals can be grown from a molten sodium and gallium (Na/Ga) melt held under 100 atmospheres of pressure of N2 at 750° C. As Ga will not react with N2 below 1000° C., the powder is made from something more reactive, usually in one of the following ways:

$$2Ga+2NH3\rightarrow 2GaN+3H2$$

$$Ga2O3+2NH3\rightarrow 2GaN+3H2O$$

Gallium nitride can also be synthesized by injecting ammonia gas into molten gallium at 900-980° C. at normal atmospheric pressure.

In some embodiments, step 2902 can include molecular beam epitaxy. GaN crystals can be grown using molecular beam epitaxy or metalorganic vapor phase epitaxy. These processes can be further modified to reduce dislocation densities. First, an ion beam is applied to the growth surface in order to create nanoscale roughness. Then, the surface is polished. The one or more of the aforesaid processes can occur in a vacuum.

Referring back to step 2904 of method 2900, a large GaN stone produced at step 2902 can be cut into multiple rough synthetic gemstones, each cut stone having a selected weight. The rough cut gemstone preferably has a cubic or approximately cubic shape. In order to produce a finished gemstone as illustrated in FIGS. 5 to 28, the cut rough stones from the one large stone can be further cut and polished such as according to a known gem fashioning process or a novel fashioning process for GaN stones.

The final fashioning of the gemstones at step 2904 can include one or more of four techniques: faceting, tumbling, cabbing and carving. Faceting produces flat faces (facets) on gems of many different shapes. Transparent and highly translucent gems can be faceted. Less translucent and opaque stones can be tumbled, cabbed or carved because the optical properties associated with faceting depend on light reflecting from inside the stone. The faceted gems can have three main parts: crown, girdle, and pavilion. And such parts can be fashioned at step 2904. As shown in FIGS. 5 to 28, a crown is the top part of a gemstone, a pavilion is the bottom part, and the girdle is the narrow section that forms the boundary between the crown and pavilion. The girdle can be used as a setting edge of the gemstone.

At step 2904, a colored or colorless gemstone can be grinded into an approximate shape and dimensions of the finished stone. This sub-process of step 2904 is called preforming. Preforming uses a coarse abrasive on the stone. Diamond grit embedded in a nickel-plated copper disc can be used for preforming the GaN stone. In some embodiments, water can be used as a wetting agent in preforming and the rest of the faceting sequence. Lapidaries use various arrangements to keep the wheels wet. Before grinding in the facets, the lapidary can mount the colored stone on a dopstick. The procedure is called dopping. The stone is gently heated, then brought up against the end of the dop, which has been dipped into melted dopping wax. Once the preform has set in position, it is set aside to cool. All the aforesaid steps of preforming can be a part of step 2904.

Also, at step 2904, the facets of the stone can be ground and polished on horizontally spinning wheels called laps. Lapidaries use a series of cutting laps with progressively finer grit to grind in the facets, gradually smoothing out their surfaces. Then they do final polishing on a special polishing lap. Polishing laps are made from a variety of materials. The polishing agents with which these are charged are finely ground powders, including diamond, corundum, cerium oxide, and tin oxide. To cut and polish consistently at the same desired angles, the faceter attaches the dopstick to a device that holds the stone in position as it meets the lap. The traditional setup used in many colored stone shops is the jamb peg. This has a block mounted on a vertical post. The dopstick fits into one of a series of holes on the side of the block. The position of each hole sets a specific angle (from the girdle plane) at which the facet is cut. Turning the dopstick in the hole places all the facets of a given type at the same angle in their circuit around the stone. All the aforesaid steps performed by lapidaries can be a part of step 2904.

Also, at step 2904, novel fashioning processes can be applied to the GaN stones that are specialized for GaN stones. Because the refractive index of GaN can be at least equal to or slightly greater than that of diamond and other gemstones, the GaN gemstones described herein can be fashioned according to precision diamond cuts using diamond hand tools known as tangs. Tangs allow the cutter to set and adjust the angle of the facet, something the cutter is unable to do with colored stone hand tools which are preset. It is the precision of the diamond hand tools, tangs, which enables the cutter to use the angles and proportions of a diamond, resulting in "sharp edges" on the gallium nitride gemstones. However, because gallium nitride is not as hard as diamond, traditional colored stone lap wheels can be used in the faceting process at rotational speeds less than those speeds typically used for diamonds, i.e., less than 3000 RPM, and preferably at rotational speeds on the order of 300 RPM. However, in some other embodiments, because gallium nitride is almost as hard as diamond, speeds can be increased on lap wheels to speeds used for diamonds.

In some embodiments, at step 2904, the gallium nitride rough gemstone can be mounted on a dopstick and secured within the top tang. The edge girdle can be cut first on the grinding wheel. This determines the shape of the stone. The table, the flat top, which is the biggest facet on the whole stone, is cut next also using the table tang. The table is then polished using a four-step process of laps (disks, wheels or sciaves) progressing from rough to smooth grit sizes. Polishing can begin with a 600-grit lap moving to a 1200-grit lap, then to a 3000-grit lap and ending with a ceramic disk having an effective grit size of 0.5 to 1 micron, which can be the smoothest setting. The dop can then be transferred to a top tang to cut the top side and make the crosswork which consists of four basics (facets). Then the dop is transferred to a bottom tang and the bottom side is cut into the crosswork which consists of four basics (facets). At this time, the stone can be examined by visual inspection (by human or computer vision) to determine its precision. After the inspection, a polishing process can occur. Also, the dop can be transferred to the top tang and the top side star facets—there are eight of such facets cut along with the upper girdle facets (16 facets), and the dop can be transferred to the bottom tang and lower girdle facets (16 facets) are cut. The inspection and polishing process can then be repeated. Finally, the rough stone is now a faceted and polished round brilliant gemstone—such as shown in FIGS. 5 to 7. Also, analogous steps can be used to produce the gemstones illustrated in FIGS. 8 to 28.

FIGS. 30 and 31 illustrate schematic views of jewelry apparatus 3000 in two different jewelry applications, with some portions of the jewelry apparatus being broken away to reveal internal details of construction, in accordance with some embodiments of the present disclosure. The jewelry apparatus 3000 includes a synthetic gemstone 3001 combined with an LED system 3002 configured to illuminate the gemstone. As shown, the LED system 3002 includes an outer housing 3002*a* and an inner housing 3002*b*. The outer housing attaches the synthetic gemstone 3001 to the LED system 3002 as well as contains the inner housing 3002*b* that contains circuitry of the LED system. The LED system includes circuitry components that includes an LED 3003. The LED 3003 is configured to illuminate the synthetic gemstone 3001 when voltage is applied to the LED. The illuminating element of the LED 3003 is encapsulated by a dome 3004 (which can be a part of a bulb). The circuitry components also include a resistor 3005 connected to the LED 3003. And, connected to the resistor 3005 is a switch 3006 that can be controlled by a wireless signal. The switch 3006 includes an antenna for receiving a control signal for turning on and off the LED 3003. The circuitry components also include a battery 3007 which is downstream of the switch and that powers the switch so it can turn on and off the LED 3003. When the switch closes the circuitry of the LED system the LED 3003 receives power from the battery 3007 and illuminates. The gemstone being at least partially translucent and adjacent to the LED 3003 is illuminated when the LED is illuminated. In some embodiments, the circuitry components of the LED system 3002 are in series with each other (as depicted).

As shown in FIG. 30, the jewelry apparatus 3000 is part of an earring 3008 having earing post 3009. The back of the earring 3008 is not depicted and can be any known back of an earring. As shown in FIG. 31, the jewelry apparatus 3000 is part of an illuminating ring 3108 having ring structure 3109.

Figure 32:
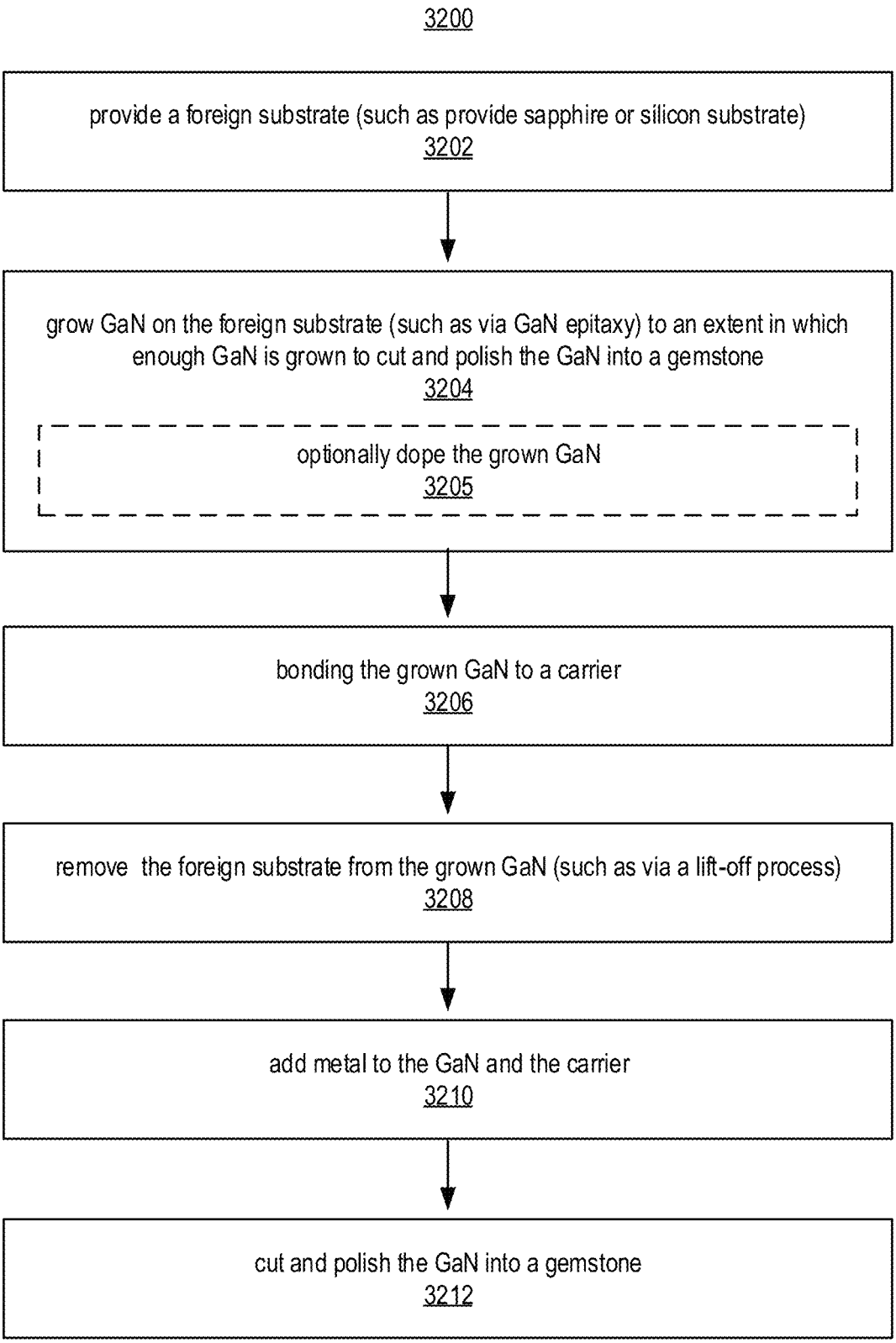
FIGS. 32 and 33 illustrate methods for fabricating synthetic gemstones that can function as light-emitting diodes (LEDs), in accordance with some embodiments of the present disclosure.
Figure 33:
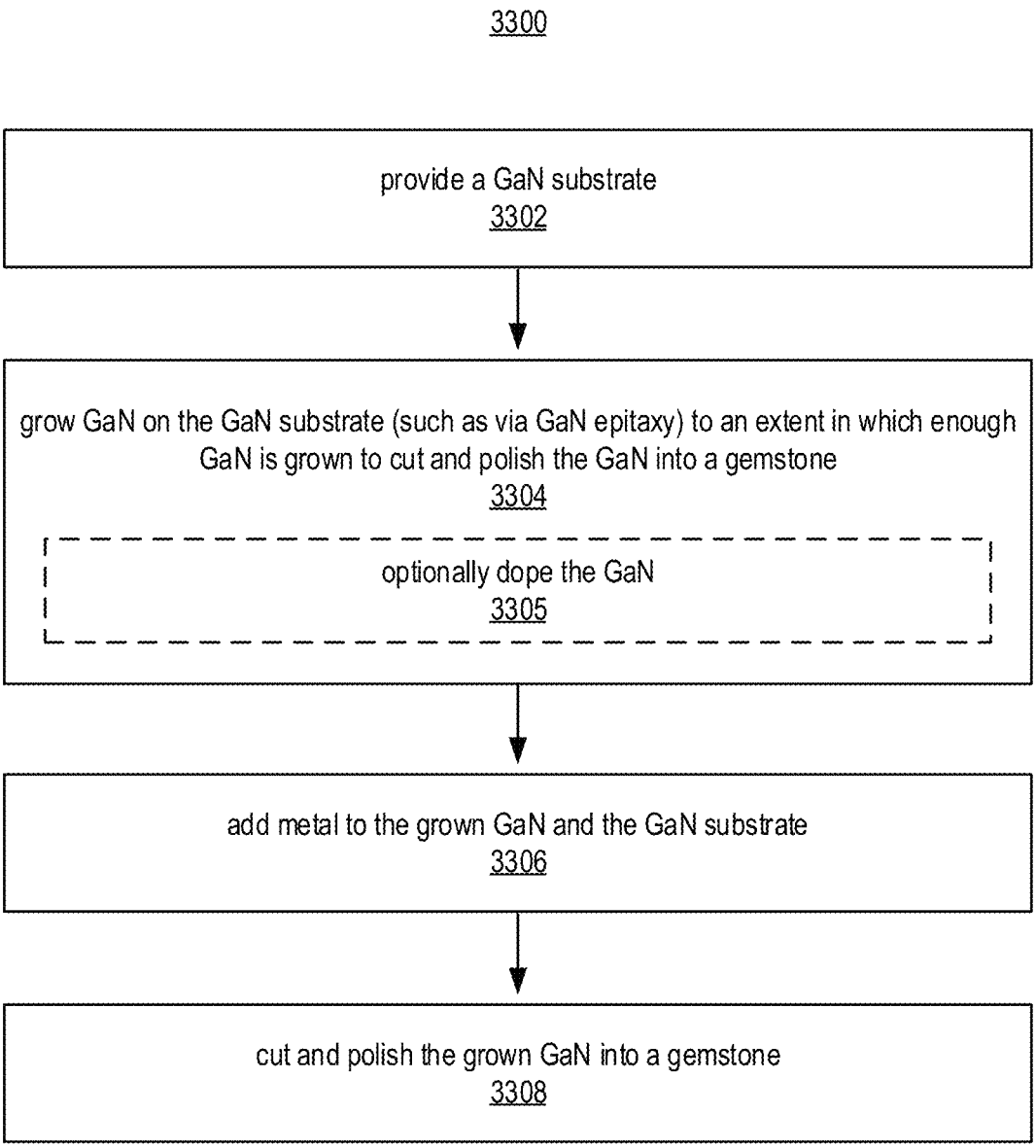

FIGS. 32 and 33 illustrate methods for fabricating synthetic GaN gemstones that can function as light-emitting diodes (LEDs), in accordance with some embodiments of the present disclosure. Specifically, FIG. 32 illustrates a method 3200 for fabricating a synthetic GaN gemstone that functions as an LED that starts with using a foreign substrate. FIG. 33 illustrates a method 3300 for fabricating a synthetic GaN gemstone that functions as an LED that starts with using a GaN substrate.

As shown, the method 3200 begins, at step 3202, with providing a foreign substrate (such as provide a sapphire substrate or a silicon substrate). The method 3200 continues, at step 3204, with growing GaN on the foreign substrate (such as via GaN epitaxy) to an extent in which enough GaN is grown to cut and polish the GaN into a gemstone. Step 3204 can be similar to or include operations of step 2902 of method 2900, or vice versa. For example, optionally, the method 3200 can continue, at step 3205, with doping the grown GaN. And, at step 3204, gallium nitride crystals can be grown in a wide range of colors (including green, blue, red, violet, yellow, and orange) and shades within each color by selection of certain amounts of dopants (e.g., p-type dopants, n-type dopants, silicon, oxygen, boron, aluminum, indium, thallium, tin, lead, bismuth, and transition metals, such as magnesium) and by varying the net doping densities (concentrations)—at step 3205. In some embodiments, undoped gallium nitride crystals in the hexagonal or rhombohedral forms are colorless and meet, or exceed, the brilliance of diamond.

At step 3206, the method 3200 continues with bonding the grown GaN to a carrier. At step 3208, the method 3200 continues with removing the foreign substrate from the grown GaN (such as via a lift-off process). The bonding can include wafer bonding, and the lift-off process can include wafer lift-off. The carrier is a carrier substrate that holds the gemstone or the GaN and allows for the resulting LED in the gemstone to illuminate more effectively than if the GaN was provided with the foreign substrate.

At step 3210, the method 3200 continues with adding metal to the GaN and the carrier. At step 3210, a metallization method can be used for transforming the grown GaN into an LED. Step 3210 can also include a thinning method. Any metallization and thinning method can be used that is known in the art of LED manufacturing.

At step 3212, the method 3200 continues with cutting and polishing the GaN into a gemstone. Step 3212 can be similar to or include operations of step 2904 of method 2900, or vice versa. For example, the finished gemstones produced at step 3212 can have a hardness approaching or exceeding that of diamond, acceptable toughness for fabricating gemstones further, acceptable thermal and chemical stability, and a high refractive index that renders the gallium nitride gemstone as brilliant, if not more brilliant, than diamond. Instead of slicing the large crystal into many thin slices, the crystals can serve as boules that are cut into rough synthetic gemstones having a weight on the order of, for example, 1/16 to 10 carats. This last-mentioned step can be a part of step 3212. The rough gemstones can then be fashioned into finished synthetic GaN gemstones at step 3212. The faceting and polishing techniques can be derived from those techniques used in connection with the faceting and polishing of colored gemstones such as rubies and sapphire, incorporating certain procedures utilized in connection with diamonds.

The method 3200, which produces an LED in a gemstone, shows a more conventional process of using a foreign substrate such as sapphire or silicon, in which best performance is achieved by having the substrate removed and replaced by a carrier substrate. The method 3200 includes additional steps (wafer bonding and lift-off) and material (carrier), resulting in longer wafer fabrication cycle times and higher costs compared to the process for producing a gemstone with an LED shown by method 3300 in FIG. 33. The process in method 3300 does not use a foreign substrate; and thus, a foreign substrate does not need to be removed from the resulting LED.

As depicted in FIG. 33, the method 3300 begins, at step 3302, with providing a GaN substrate—instead of a foreign substrate. The method 3300 continues, at step 3304, with growing GaN on the GaN substrate (such as via GaN epitaxy) to an extent in which enough GaN is grown to cut and polish the GaN into a gemstone. Step 3304 can be similar to or include operations of step 2902 of method 2900, or vice versa. For example, optionally, the method 3300 can continue, at step 3305, with doping the grown GaN. And, at step 3304, gallium nitride crystals can be grown in a wide range of colors (including green, blue, red, violet, yellow, and orange) and shades within each color by selection of certain amounts of dopants (e.g., p-type dopants, n-type dopants, silicon, oxygen, boron, aluminum, indium, thallium, tin, lead, bismuth, and transition metals, such as magnesium) and by varying the net doping densities (concentrations)—at step 3305. In some embodiments, undoped gallium nitride crystals in the hexagonal or rhombohedral forms are colorless and meet, or exceed, the brilliance of diamond.

At step 3306, the method 3300 continues with adding metal to the grown GaN and the GaN substrate. At step 3306, a metallization method can be used for transforming the grown GaN into an LED. Step 3306 can also include a thinning method. Any metallization and thinning method can be used that is known in the art of LED manufacturing.

At step 3308, the method 3300 continues with cutting and polishing the grown GaN into a gemstone. Step 3308 can be similar to or include operations of step 2904 of method 2900, or vice versa. For example, the finished gemstones produced at step 3308 can have a hardness approaching or exceeding that of diamond, acceptable toughness for fabricating gemstones further, acceptable thermal and chemical stability, and a high refractive index that renders the gallium nitride gemstone as brilliant, if not more brilliant, than diamond. Instead of slicing the large crystal into many thin slices, the crystals can serve as boules that are cut into rough synthetic gemstones having a weight on the order of, for example, 1/16 to 10 carats. This last-mentioned step can be a part of step 3308. The rough gemstones can then be fashioned into finished synthetic GaN gemstones at step 3308. The faceting and polishing techniques can be derived from those techniques used in connection with the faceting and polishing of colored gemstones such as rubies and sapphire, incorporating certain procedures utilized in connection with diamonds.

FIGS. 34 and 35 illustrate schematic views of jewelry including a synthetic gemstone 3401 that functions as an LED, and in some embodiments, such a gemstone can be fabricated via the method 3200 or the method 3300. Specifically, FIGS. 34 and 35 illustrate schematic views of jewelry apparatus 3400 in two different jewelry applications, with some portions of the jewelry apparatus being broken away to reveal internal details of construction, in accordance with some embodiments of the present disclosure. The jewelry apparatus 3400 includes the synthetic gemstone 3401 combined with an LED system 3402 configured to illuminate the gemstone. As shown, the LED system 3402 includes an outer housing 3402*a* and an inner housing 3402*b*. The outer housing attaches the synthetic gemstone 3401 to the LED system 3402 as well as contains the inner housing 3402*b* that contains circuitry of the LED system. The LED system includes circuitry components that includes an LED 3403. As shown, the LED 3403 is integrated in the gemstone 3401; and thus, the gemstone 3401 functions as an LED. The LED integrated gemstone shown in FIGS. 34 and 35 can be fabricated via one of the methods 3200 and 3300. The LED 3403 is configured to illuminate the synthetic gemstone 3401 when voltage is applied to the LED. The illuminating element of the LED 3403 is encapsulated by the gemstone 3401. The circuitry components also include a resistor 3405 connected to the LED 3403. And, connected to the resistor 3405 is a switch 3406 that can be controlled by a wireless signal. The switch 3406 includes an antenna for receiving a control signal for turning on and off the LED 3403. The circuitry components also include a battery 3407 which is downstream of the switch and that powers the switch so it can turn on and off the LED 3403. When the switch closes the circuitry of the LED system the LED 3403 receives power from the battery 3407 and illuminates; thus, the gemstone 3401 illuminates. The gemstone being at least partially translucent and encapsulating the light emitting component of the LED 3403 is illuminated when the LED is illuminated. In some embodiments, the circuitry components of the LED system 3402 are in series with each other (as depicted).

As shown in FIG. 34, the jewelry apparatus 3400 is part of an earring 3408 having earing post 3409. The back of the earring 3408 is not depicted and can be any known back of an earring. As shown in FIG. 35, the jewelry apparatus 3400 is part of an illuminating ring 3508 having ring structure 3509.

While the invention has been described in conjunction with the specific embodiments described herein, it is evident that many alternatives, combinations, modifications and variations are apparent to those skilled in the art. Accordingly, the example embodiments of the invention, as set forth herein are intended to be illustrative only, and not in a limiting sense. Various changes can be made without departing from the spirit and scope of the invention.

What is claimed is:

1. A gemstone, comprising a crystal that comprises synthetic gallium nitride and polished faces, wherein the polished faces are polished to an extent to let visible light pass through the faces, and wherein the visible light comprises electromagnetic radiation with wavelengths ranging from 380 to 750 nanometers.

2. The gemstone of claim 1, wherein the crystal is monocrystalline.

3. The gemstone of claim 1, wherein the polished faces are polished to an extent to let the visible light enter into the gemstone, reflect from inside the gemstone, and exit the gemstone.

4. The gemstone of claim 1, wherein the crystal comprises indium.

5. The gemstone of claim 1, wherein the crystal comprises aluminum.

6. The gemstone of claim 1, wherein the synthetic gallium nitride is intrinsic gallium nitride.

7. The gemstone of claim 1, wherein the crystal comprises a hexagonal crystal structure.

8. The gemstone of claim 1, wherein the crystal comprises a cubic crystal structure.

9. The gemstone of claim 1, wherein the crystal is colorless.

10. The gemstone of claim 1, wherein the faces are configured according to a diamond cut.

11. The gemstone of claim 10, wherein the diamond cut is a brilliant cut.

12. The gemstone of claim 10, wherein the diamond cut is a modified brilliant cut, a step cut, a mixed cut, a rose cut, a mogul cut, or any other known gemstone cut.

13. The gemstone of claim 1, wherein the crystal comprises a dopant of atoms at a concentration sufficient to produce a visibly discernable color.

14. The gemstone of claim 13, wherein the dopant comprises aluminum atoms.

15. The gemstone of claim 13, wherein the dopant comprises indium atoms.

16. A synthetic gemstone, comprising a crystal that comprises gallium nitride and polished faces, wherein the polished faces are polished to an extent to let visible light to pass through the faces, and wherein the visible light comprises electromagnetic radiation with wavelengths ranging from 380 to 750 nanometers.

17. The synthetic gemstone of claim 16, wherein the crystal is monocrystalline, and wherein the polished faces are polished to an extent to let the visible light enter into the gemstone, reflect from inside the gemstone, and exit the gemstone.

18. The synthetic gemstone of claim 17, wherein the gallium nitride is extrinsic gallium nitride and wherein the crystal comprises either indium or aluminum added to the crystal intentionally.

19. The synthetic gemstone of claim 17, wherein the gallium nitride is intrinsic gallium nitride.

20. A gemstone, comprising a crystal that comprises gallium nitride or synthetic gallium nitride and polished faces, wherein the polished faces are polished to an extent to let visible light pass through the polished faces, wherein the visible light comprises electromagnetic radiation with wavelengths ranging from 380 to 750 nanometers, and wherein the gemstone further comprises a diamond cut and the diamond cut comprises a brilliant cut, a modified brilliant cut, a step cut, a mixed cut, a rose cut, a mogul cut, or any other type of diamond cut.

* * * * *